US007278239B1

(12) United States Patent
West

(10) Patent No.: US 7,278,239 B1
(45) Date of Patent: Oct. 9, 2007

(54) GUTTER PROTECTOR AND GUTTERING INCORPORATING SAME

(75) Inventor: David Lauriston West, Nedlands (AU)

(73) Assignee: Lauriston Enterprises Pty Ltd., Nedlands W.A. (AU)

( * ) Notice: Subject to any disclaimer, the term of this patent is extended or adjusted under 35 U.S.C. 154(b) by 0 days.

(21) Appl. No.: 10/129,174

(22) PCT Filed: Mar. 19, 2000

(86) PCT No.: PCT/AU00/00255

§ 371 (c)(1),
(2), (4) Date: May 3, 2002

(87) PCT Pub. No.: WO01/33010

PCT Pub. Date: May 10, 2001

(30) Foreign Application Priority Data

Nov. 3, 1999 (AU) ..... PQ 3820
Jan. 27, 2000 (AU) ..... PQ 5273

(51) Int. Cl.
*E04D 13/00* (2006.01)

(52) U.S. Cl. ..... 52/12; 52/11; 52/95; 248/48.1; 210/474

(58) Field of Classification Search ..... 52/11, 52/12, 95; 210/474; 248/48.1, 48.2
See application file for complete search history.

(56) References Cited

U.S. PATENT DOCUMENTS 891,406 A * 6/1908 Cassens ..... 210/542
2,672,832 A * 3/1954 Goetz ..... 52/12
3,436,878 A * 4/1969 Singer
4,254,595 A * 3/1981 Crosslen ..... 52/11
4,351,134 A * 9/1982 Clarkson ..... 52/12

(Continued)

FOREIGN PATENT DOCUMENTS

AU 12566197 8/1997

(Continued)

OTHER PUBLICATIONS http://www.asseenontv.com/prod-pages/gutter_guard_gutter_covers.html, Nov. 18, 2004.*

(Continued)

*Primary Examiner*—Carl D. Friedman
*Assistant Examiner*—Yvonne M. Horton

(57) ABSTRACT

Gutter protector (10) comprises a profiled sheet (28) that extends over a gutter invert (24A) above a gutter floor (24) for collecting water and debris that would otherwise directly collect in the gutter invert (24A). The gutter protector (10) includes a spacer (30) for spacing adjacent profiled sheets (28) by a first gap (32) that allows water to the substantial exclusion of leaves and debris to fall through the gap (32) into the underlying gutter invert (24A). The profiled sheet (28) includes a planer liquid impervious portion (34) having an outer edge (36) adjacent an outer wall (22) of gutter (12) and an inner edge (38) disposed to lie adjacent or in substantial alignment with a lower edge (40) of a roof covering (18). A channel (48) is disposed adjacent to and extends along the inner edge (38) of planar portion (34). Channel (48) has a base (50) below the planar portion and a first wall (52) that extends between the base (50) and inner edge (38). The first wall (52) is provided with a plurality of holes (54) and a series of spaced apart ribs (56). A second wall (60) extends upwardly from the opposite side of channel (48) and sits inside inner wall (20) of the gutter (12).

23 Claims, 6 Drawing Sheets

U.S. PATENT DOCUMENTS

| | | | | | |
|---|---|---|---|---|---|
| 4,435,925 | A | * | 3/1984 | Jefferys | 52/12 |
| 4,445,301 | A | * | 5/1984 | Tanski | 52/11 |
| 4,447,994 | A | * | 5/1984 | Garneau | 52/11 |
| 4,455,791 | A | * | 6/1984 | Elko et al. | 52/12 |
| 4,467,570 | A | * | 8/1984 | Kriegel | 52/12 |
| 4,573,290 | A | * | 3/1986 | Fleming | 52/12 |
| 4,592,174 | A | * | 6/1986 | Hileman | 52/12 |
| 4,604,837 | A | * | 8/1986 | Beam | 52/12 |
| 4,616,450 | A | * | 10/1986 | Shouse | 52/12 |
| 4,796,390 | A | * | 1/1989 | Demartini | 52/12 |
| 4,858,396 | A | | 8/1989 | Rose et al. | |
| 4,866,890 | A | | 9/1989 | Otto | |
| 4,888,920 | A | * | 12/1989 | Marulic | 52/12 |
| 4,965,969 | A | * | 10/1990 | Antenen | 52/12 |
| 5,072,551 | A | * | 12/1991 | Manoogian, Jr. | 52/12 |
| 5,181,350 | A | * | 1/1993 | Meckstroth | 52/12 |
| 5,216,851 | A | * | 6/1993 | Kuhns | 52/12 |
| 5,305,562 | A | * | 4/1994 | Sapia | 52/12 |
| 5,375,379 | A | * | 12/1994 | Meckstroth | 52/12 |
| 5,459,965 | A | * | 10/1995 | Meckstroth | 52/12 |
| 5,640,809 | A | * | 6/1997 | Iannelli | 52/12 |
| 5,737,879 | A | * | 4/1998 | Sweet | 52/12 |
| 5,911,659 | A | * | 6/1999 | Serano | 52/12 |
| 5,966,875 | A | * | 10/1999 | Kuhns | 52/12 |
| 6,016,631 | A | * | 1/2000 | Lowrie, III | 52/11 |
| 6,161,338 | A | * | 12/2000 | Kuhns | 52/12 |
| 6,269,592 | B1 | * | 8/2001 | Rutter | 52/12 |
| 6,412,228 | B1 | * | 7/2002 | Meckstroth | 52/12 |
| 6,598,352 | B2 | * | 7/2003 | Higginbotham | 52/12 |
| 6,735,907 | B2 | * | 5/2004 | Stevens | 52/12 |

FOREIGN PATENT DOCUMENTS

| | | |
|---|---|---|
| JP | 7-062818 A | 3/1995 |

OTHER PUBLICATIONS http://www.hallettent.com/instructions.asp, Jun. 5, 2002.*

* cited by examiner

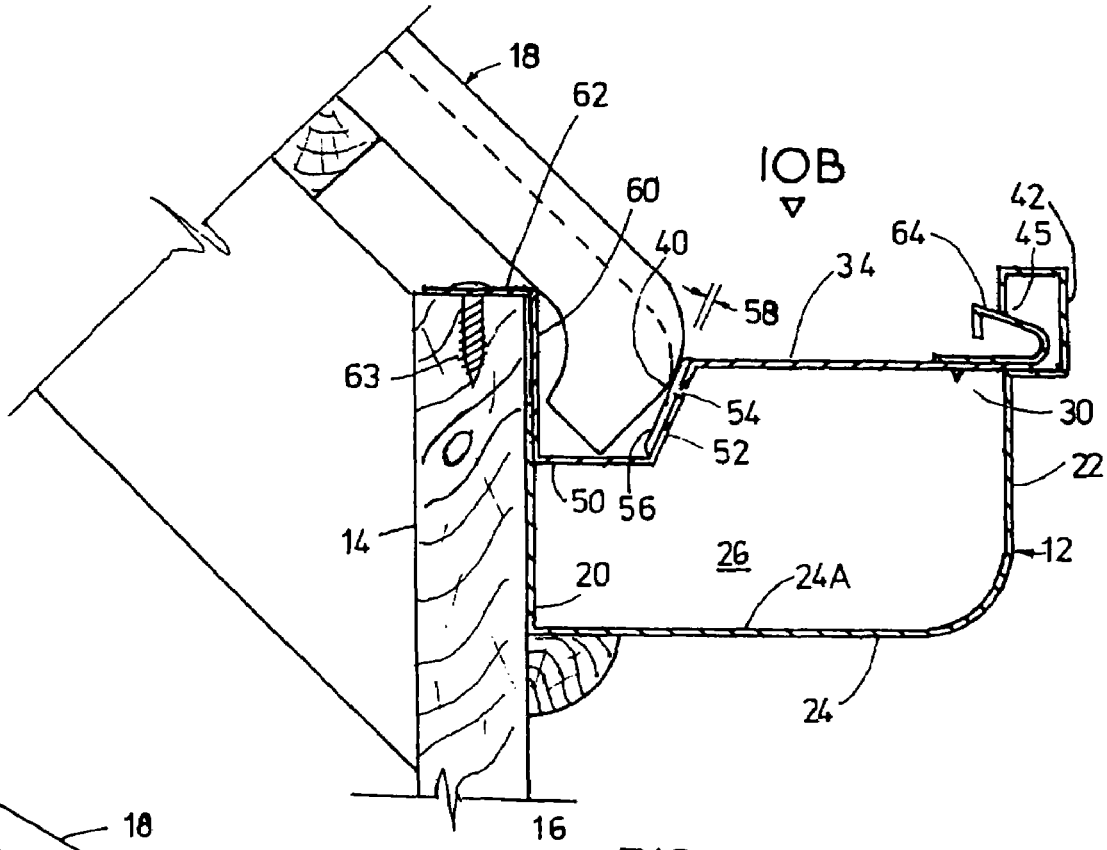
FIG.7
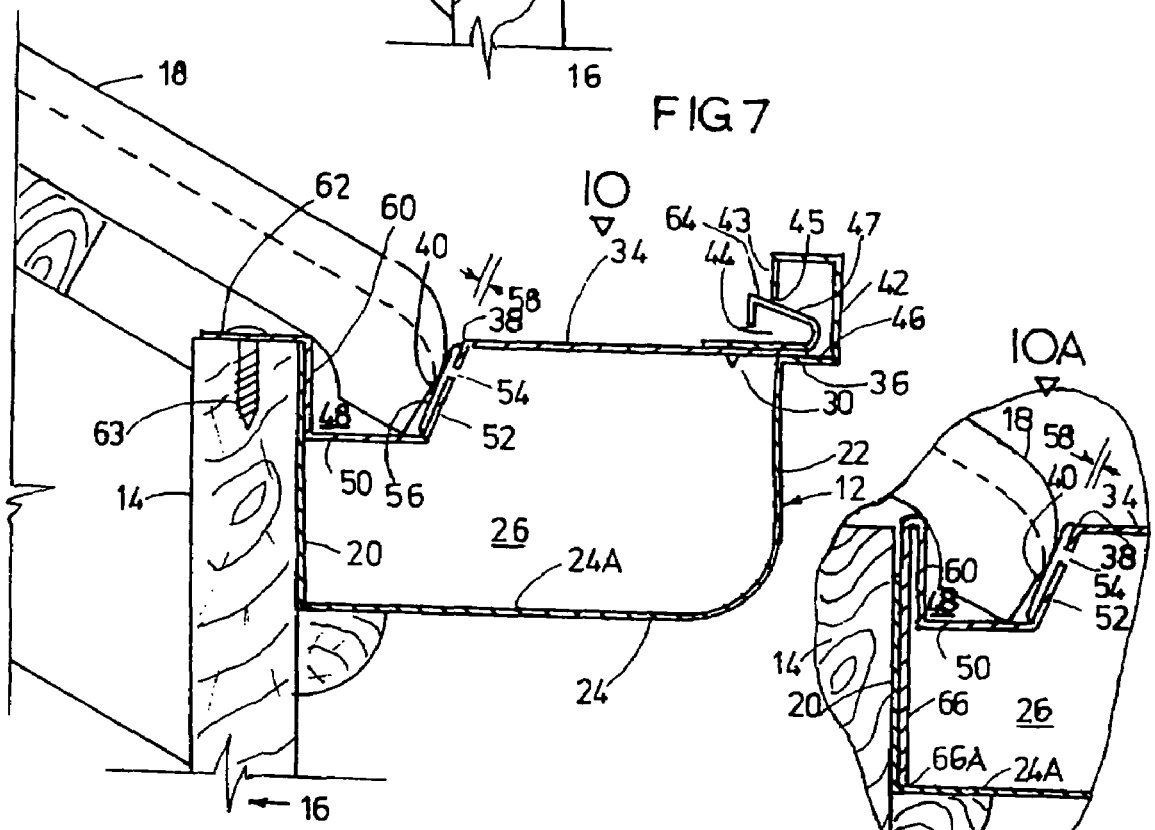
FIG.5
FIG.6

GUTTER PROTECTOR AND GUTTERING INCORPORATING SAME

FIELD OF THE INVENTION

The present invention relates to a gutter protector and to a gutter incorporating the gutter protector.

BACKGROUND OF THE INVENTION

The purpose of roof gutters is to collect rain-water and melted snow (in snow fall areas) that runs off a roof which is then discharged into connected downpipes to drainage or storage tanks. The latter purpose will become increasingly important in the future and it will become important that the water is relatively free of rotting organic matter.

Gutters have to be relatively simple and low in cost to manufacture and construct.

Most gutters are open and will collect leaves and debris from the roof and surrounding trees. These will be washed along in the gutter and can form a "dam" which will block the free flow of water in the gutter. Such blockages can cause the water to over-flow the back of the gutter and damage the eaves lining and ceilings. The leaves and debris will also contaminate the water that is discharged from the down-pipes.

There have been many systems using mesh or a covering with holes that have been placed over the open face of gutters to prevent leaves and debris clogging the gutter and restricting or blocking the full flow of water. Some of these have additions to traditional gutters while others have been a complete assembly.

Gutters that have been covered with the finer mesh have the disadvantage that they do not readily allow the water to flow through into the gutter and can over-flow with heavier falls of rain. Gutters covered with the larger meshes allow the water to fall through the mesh to the gutter but also allow smaller leaves and debris to fall into the gutter and cause "damming" and blockage of the flow of water. Meshes also do not add to the strength of the gutter and gutter clips or straps are required to support the gutter which contribute to the collection of leaves and debris. Both fine and course meshes suffer the disadvantage of not providing wind uplift that occurs with a full surface to lift and blow the leaves out of the gutter.

With meshes made of metal wire, corrosion of the gutter and mesh can result if the metals from which the wire and the gutter are manufactured are dissimilar, causing bi-metallic corrosion due to an electro-chemical process.

Generally the flow of the rain-water off the roof is dispersed over the mesh surface and with lower intensity rainfalls does not cause a sufficient torrent of water to clear debris from the invert of the gutter and will allow this to accumulate to form dams when the velocity of the water is low. These in turn cause the velocity of water flow in the gutter from later flows to be reduced which will allow further debris to settle and collect at the "dams". This continual process is likely to eventually block the gutter.

SUMMARY OF THE INVENTION

It is an object of the present invention to provide a gutter protector that attempts to reduce the likelihood of water flow restriction or blockage of gutters.

According to a first aspect of the present invention there is provided a gutter protector for use with a gutter attached to a building the gutter having an inner wall located adjacent the building, a laterally spaced outer wall and an invert therebetween, said walls and invert defining a gutter channel, said gutter protector comprising at least:

collector means extending over said gutter channel and above said invert for collecting water and debris that would otherwise directly collect in the gutter channel;

spacer means for spacing adjacent collector means by a first gap that allows water to the substantial exclusion of debris to fall through the first gap into the gutter invert.

Preferably said collector means includes a planar liquid impervious portion having an outer edge adjacent said outer wall of the gutter and an inner edge disposed adjacent or in substantial alignment with a lower edge of a roof covering supported on the building and disposed above the gutter.

Preferably said collector means includes a channel disposed adjacent and extending along said inner edge of said planar portion, the collector channel having a base disposed below said planar portion.

Preferably said collector channel includes a first side wall extending from the channel base to the inner edge of the planar portion, said first wall provided with at least one aperture at a predetermined level above said base through which water falls onto the gutter invert when water in the collector channel is above said predetermined level.

Preferably said first wall is provided with at least one protrusion for abutment with the lower edge of the roof covering to form a second gap between the first wall and the roof covering.

Preferably the first wall is inclined to form an obtuse included angle with the base.

Preferably said collector channel includes an upwardly extending second wall laterally spaced from the first wall by the base for coupling with said building.

Preferably the second wall includes a flange for disposing over a fascia of the building.

Preferably the second wall extends upwardly above the planar portion.

In an alternate embodiment, the collector means includes a third wall having a portion extending below from the collector channel on a side adjacent the second wall for seating on said gutter invert. Conveniently, the third wall is a folded portion of the second wall.

Preferably said gutter protector further includes a clip for releasably attaching the collector means to the gutter.

In one embodiment, the spacer means is formed integrally within said clip.

In a further variation said clip is formed integrally with said collector means.

Preferably said clip includes engagement means on an outer surface for an engagement with an edge of the outer wall of the gutter whereby said clip acts between said outer wall of the gutter and said collector means to hold said collector means in said gutter.

In an alternate embodiment said spacer means is formed integrally along at least one transverse edge along the collector means.

Preferably said collector means is one of a plurality of side by side integrally formed collector means.

According to the present invention there is also provided a gutter comprising at least:

an inner wall for location adjacent a building to which the gutter is attached;

a laterally spaced outer wall and an invert therebetween, said walls and invert defining a gutter channel; and a gutter protector in accordance with the first aspect of this invention coupled to said gutter and extending over said gutter invert.

The invention also provides a method of reducing the likelihood of water flow restriction in a gutter having an inner wall, a laterally spaced outer wall and an invert therebetween, said walls and invert defining a gutter channel, said method comprising the steps of:

providing a plurality of substantially liquid impervious plates;

disposing said plates side by side over said gutter and above said gutter invert;

spacing mutually adjacent plates to form a gap of a size to allow water to the substantial exclusion of debris to fall therethrough onto the invert said gap extending across the gutter channel between said inner wall and said outer wall.

BRIEF DESCRIPTION OF THE DRAWINGS

Embodiments of the present invention will now be described by way of example only with reference to the accompanying drawings in which:

FIG. 5 is a section view of the gutter protector in use in conjunction with a tiled roof;

FIG. 6 is a section view of a second embodiment of the gutter protector;

FIG. 7 is a section view of a third embodiment of the gutter protector;

FIG. 14A is an elevation from the outer wall of the gutter of FIG. 14;

FIG. 14B is a view of section A-A of FIG. 14;

FIG. 15A is an elevation from the outer wall of the gutter of FIG. 15;

FIG. 15B is a view of section A-A of FIG. 15; and

FIG. 15C is a view of section B-B of FIG. 15 incorporating an integral clip.

DETAILED DESCRIPTION OF THE PREFERRED EMBODIMENTS

Figure 2:
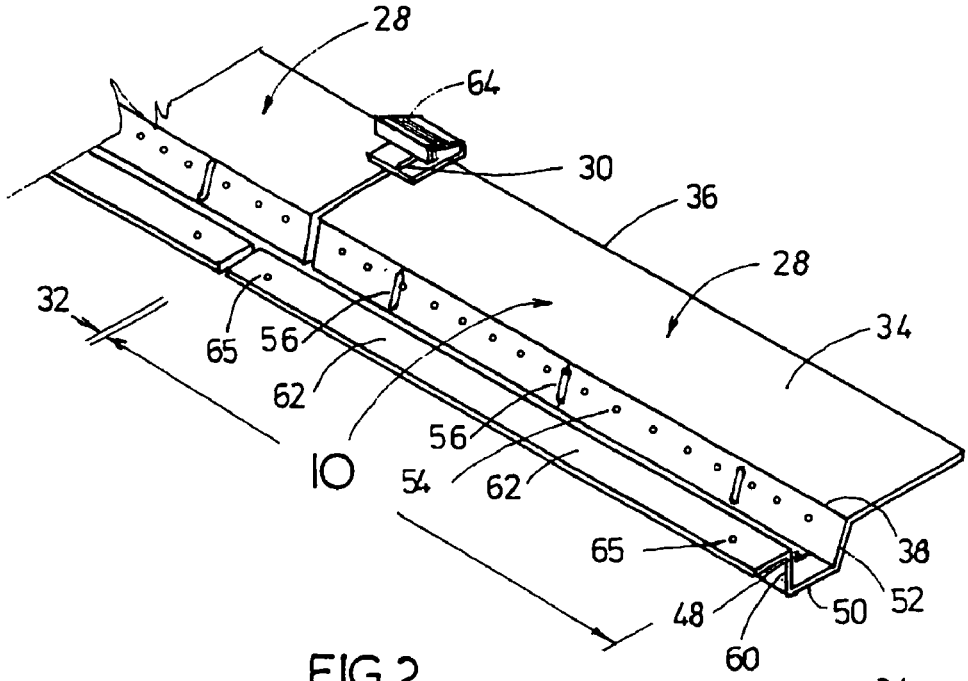
FIG. 2 is a perspective view of a gutter protector depicted in FIG. 1.
Figure 1:
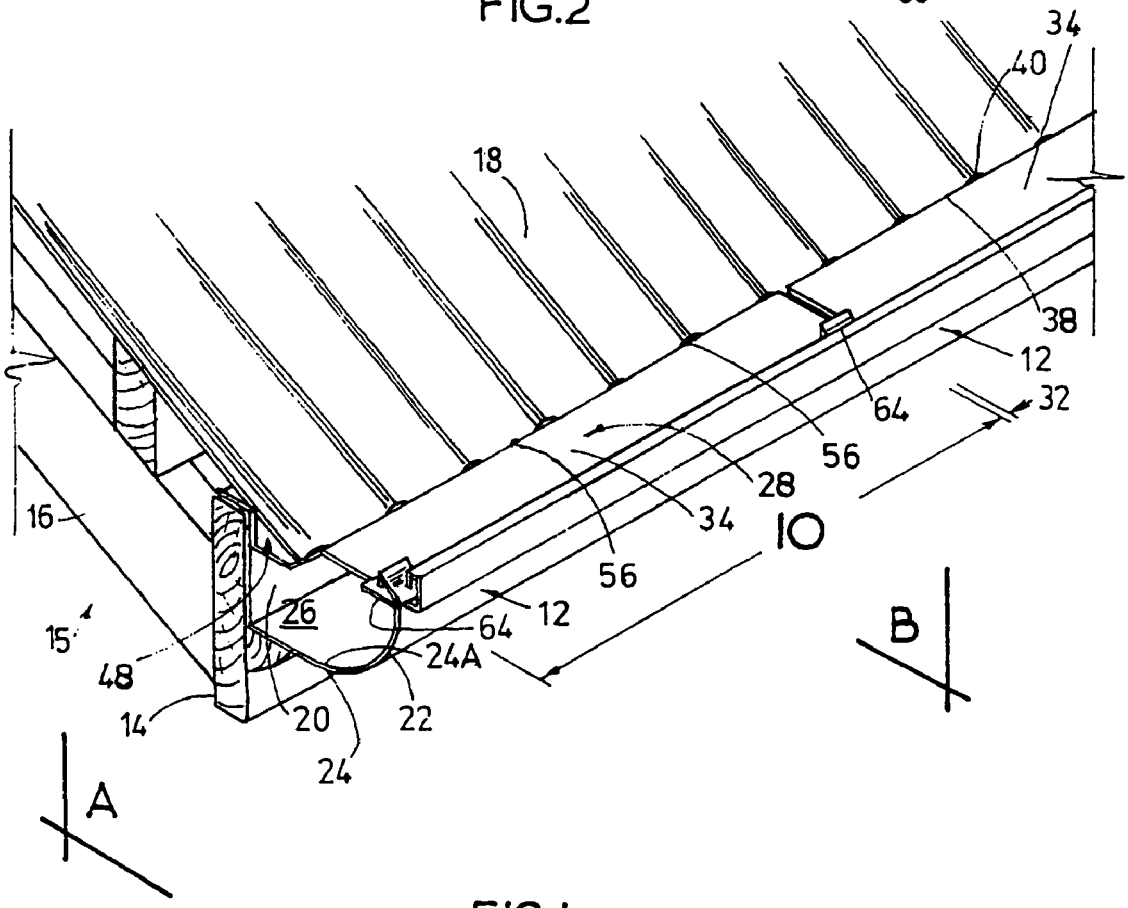
FIG. 1 is a schematic representation of a roofing assembly to which a first embodiment of the gutter protector is fitted.
Figure 4:
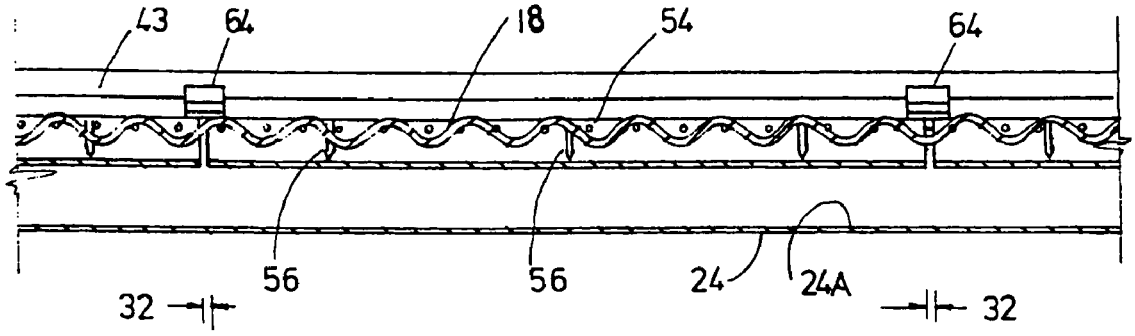
FIG. 4 is a view of section A-A of FIG. 1.

FIGS. 1-5 depict a first embodiment of a gutter protector 10 for use with a gutter 12. For the purpose of providing the context of the present invention, the gutter 12 would typically be attached to a fascia 14 of a building 15 which is fixed to rafters 16 that support a roof covering 18. The gutter 12 includes an inner wall 20 which would be located adjacent the fascia 14, a laterally spaced outer wall 22 and an invert 24A disposed between the walls 20 and 22. The walls 20, 22 and the floor 24 define a gutter channel 26. The invert 24A is the side of floor 24 inside the channel 26.

The gutter protector 10 comprises a collector means in the form of sheet or plate 28 that extends over the gutter channel 26 and above the gutter invert 24A for collecting water, leaves and other debris that would otherwise directly collect in the gutter channel 26. More particularly, the profile sheet 28 is disposed between the gutter channel 26 and the roof covering 18. The gutter protector 10 also includes a spacer 30 for spacing adjacent profiled sheets 28 by a first gap 32 that allows water to the substantial exclusion of debris to fall through the gap 32 onto the underlying gutter invert 24A.

Looking at the gutter protector in more detail, it will be seen that the sheet or plate 28 includes a planar liquid impervious portion 34 having an outer edge 36 adjacent the outer wall 22 and an inner edge 38 disposed to lie adjacent or in substantial alignment with a lower edge 40 of the roof covering 18. The outer wall 22 of most gutters 12 of conventional shape and configuration include an upper rolled edge 42. The rolled edge 42 includes a wall 43 provided with an opening 44 and having an upper edge 45. In the present embodiment, the outer edge 36 of the planar portion 34 seats inside the opening 44 on a ledge 46 provided by the formation of the rolled edge 42.

A collector channel 48 is disposed adjacent to and extends along the inner edge 38 of planar portion 34. The collector channel 48 has a base 50 disposed below the planar portion 34 and a first wall 52 of channel 48 extends from the base 50 to the inner edge 38. The first wall 52 is provided with a plurality of apertures 54 at a predetermined level above the base 50 through which water can fall into the gutter channel 26 when water in the channel 48 is above the predetermined level.

The first wall 52 is inclined at an obtuse included angle relative to the base 50. The surface of the first wall 52 facing the roof covering 18 is also provided with a series of protrusions or ribs 56 that extend linearly from the inner edge 38 to the base 50. The ribs 56 abut with the lower edge 40 of the roof covering 18 to form a gap 58 between the roof covering 18 and the wall 52. In one embodiment the ribs 56 are about 1 to 2 mm in height and about 90 mm apart. The gap 58 is dimensioned similar to gap 32 so as to allow for the passage of water into the channel 48 but to the substantial exclusion of leaves and other debris.

The channel 48 also includes an upwardly extending second wall 60 laterally spaced from the first wall 52 by the base 50 for coupling with the building 15. The second wall 60 sits inside the inner wall 20 of the gutter 12 and in the embodiment depicted in FIGS. 1-5 is provided with a laterally extending flange 62 for disposing over the fascia 14. This enables an option for connection to the fascia 14 by way of a screw or nail 63 or other mechanical fastener passing through holes 65 formed in flange 62.

In this particular embodiment, the gutter protector 10 is attached at its outer edge to the gutter 12 by means of a clip 64. Clip 64 is typically a spring clip that fits inside the opening 44 and jams the planar portion 34 under the rolled edge 42 of the gutter 12. In this regard, the clip 64 is substantially J-shaped in section with the long leg of the J abutting the planar portion 34 and the hook part of the J abutting the upper edge 45 of opening 44. The outer surface of the hook part of the J is provided with detents in the form of a series of locking grooves or serrations 47 that seat the edge of opening 45.

The clip 64 is to be made of a material which has sufficient tensile properties, such as spring steel to form positive and secure fixing of the planar portion 34 in the rolled edge 42 of gutter 12.

In the embodiment of FIGS. 1-5 the spacer 30 is in the form of a nib projecting down from the outer surface of clip 64 facing the planar portion 34. The spacer 30 is located centrally along the width of the clip 64 so as to sit between adjacent profiled sheets 28 thereby forming the gap 32.

The gutter protector 10 may be retro fitted to an existing building or preferably installed during the construction of the building and in particular when attaching the guttering. The gutter protector 10 is applied by placing the flange 62 on the fascia 14, disposing the outer edge 36 of planar portion 34 inside the rolled edge 42 and jamming the clip 64 into the opening 44 between the planar portion 34 and the edge of opening 45. Where greater rigidity is required the flange 62 can be fixed by screws or nails 63 to the fascia 14.

The operation of the gutter protector 10 is as follows. The gutter protector 10 in effect forms a barrier to the direct entry of water or leaves and debris into the gutter channel 26. Water, leaves and other debris that would ordinarily fall directly into the channel 26 or onto the invert 24A from the roof covering 18 or from the environment now initially impinges on the gutter protector 10. The gaps 32 and 58 are dimensioned to allow water to flow through but prevent the passage of leaves or other debris from falling onto the gutter invert 24A. Typically the gaps 32 and 58 would be less than the thickness of a stem of a leaf found in the geographical location of use of the gutter protector 10. Typically the gap would be in the order of 1 to 2 mm. As leaves have an irregular shape in profile the gap size will be adequate to prevent leaves from being washed into the gutter 12. Rain water flowing down the covering 18 will either flow through the gap 58 into the channel 48 or spread onto the horizontal surface provided by the planar portion 34. Water flowing into the channel 48 and on the planar portion 34 will flow horizontally until the next gap 32 between adjacent gutter protectors 10 is reached at which time the water will fall onto the underlying gutter invert 24A. The holes 54 provide a further mechanism by which water within the channel 48 can fall onto the invert 24A in the event that the water level in the channel 48 rises to that level.

The water falling from the gutter protector 10 onto the invert 24A forms a series of waterfalls of a velocity sufficient to continually clear any small pieces of debris that may have found their way onto the invert 24A through the gaps 32, 58. It is to be recognised that the waterfalls extend transversely across the width of channel 26/invert 24A and thus act to "sweep" the gutter channel 26. This is in contrast to water falling directly from the roof cover 18 into channel 26 of a conventional uncovered gutter which forms a single waterfall that extends parallel to channel 26/invert 24A. This sweeping or clearing effect will occur at a relatively low intensity of rainfall as a result of the configuration of the gutter protector 10 and will act to continually clear the gutter 12 of debris even in light rainfall. By the combination of the planar portion 34 and the base 50 (which is also planar, thought on a lower plane than planar portion 34) the collector plate 28 in effect forms a water and debris barrier over the gutter 12, allowing water to fall primarily between the gaps 32 only onto the underlying invert 24A. In exceptionally high rainfall periods some water may also fall through holes 54.

The leaves and debris will collect on the planar portion 34 and to some extent in the region between edge 38 and roof covering 18. However due to wind uplift that occurs on flat or planar surfaces and the closeness of the planar surface 34 to the top edge of the gutter 12, the leaves and debris will be lifted and blown from these surfaces by the wind.

Leaves that may collect on the planar portion 34 will not be able to be washed along to form "dams" as occurs with an uncovered conventional gutter 12 as any flowing water will fall down the separation gaps 32 between each individual gutter protector 10. The amount of water flowing through to the gutter channel 26 will not be significantly reduced or impeded by the leaves and debris that remains on the collector/plate 28.

Therefore the operation of the gutter protector 10 will not be impaired if some leaves are lodged on the planar portion 34 or along the edge of the gap 58. In heavy downpours of rain, water flowing down the face of roof covering 18 is also likely to wash any leaves lodged at the edge of the gap 58 up onto the planar portion 34 where at a later time they can be more readily picked up by the wind and blown off. Accordingly the gutter protector 10 is largely self clearing of leaves from the planar portion 34.

In FIGS. 1-4, the roof covering 18 is in the form of corrugated sheeting. FIG. 5 illustrate the use of the gutter protector 10 with a tiled roof. Here, the gutter protector 10 and gutter 12 are identical to those depicted in FIGS. 1-4. When tiles are used as the roof covering 18 the lowermost edge 40 of the tiles projects into the channel 48 and rests on the ribs 56 on the first wall 52 to provide the gap 58 to allow water to flow into the channel 48.

A special rotary brush will be available to remove any leaves that on the planar portion 34 and in the edge of gap 58. This may be of particular importance in areas subject to bush fires as leaves caught in conventional gutters often cause the initial combination for a house to catch fire.

FIG. 6 depicts a first variation of the gutter protector 10A by which the lateral flange 62 is replaced with a downwardly depending third wall 66. The third wall 66 is on the side of the channel 48 adjacent the second wall 60 and has a lowest edge 66A for seating on the surface of invert 24A. Ideally the third wall 66 is formed by folding the second wall back onto itself. The third wall 66 acts as a fascia edge return and its use avoids the need to lift the roof covering 18 to the same degree in order to install the gutter protector 10 in comparison to the embodiment containing the lateral flange 62. This embodiment may be preferable for installation on existing gutters. It also provides easy access to the gutter 12. This option can also be used with a fascia, backboard or batten.

The gutter protector 10A will not provide the structural strength of gutter protector 10 depicted in FIGS. 1-5 where the lateral flange 62 runs over the top of fascia 14 and can be screwed or nailed to the fascia 14 which will be desirable in geographical areas where snow falls. In order to assist in supporting the gutter protector 10A it would be desirable to use gutter protector 10 or 10C at intervals along the run of the gutter 12 in a similar fashion to conventional gutter straps or clips.

FIG. 7 depicts an embodiment of the gutter protector 10B where the upper edge of the second wall 60 and the flange 62 are disposed above the plane containing the planar portion 34. This embodiment of the gutter protector 10B can be used to accommodate higher pitched roofs and various types of roof coverings. In such situations the gutter 12 would ordinarily be fixed lower on the fascia 14 than with the previous embodiments.

Figure 8:
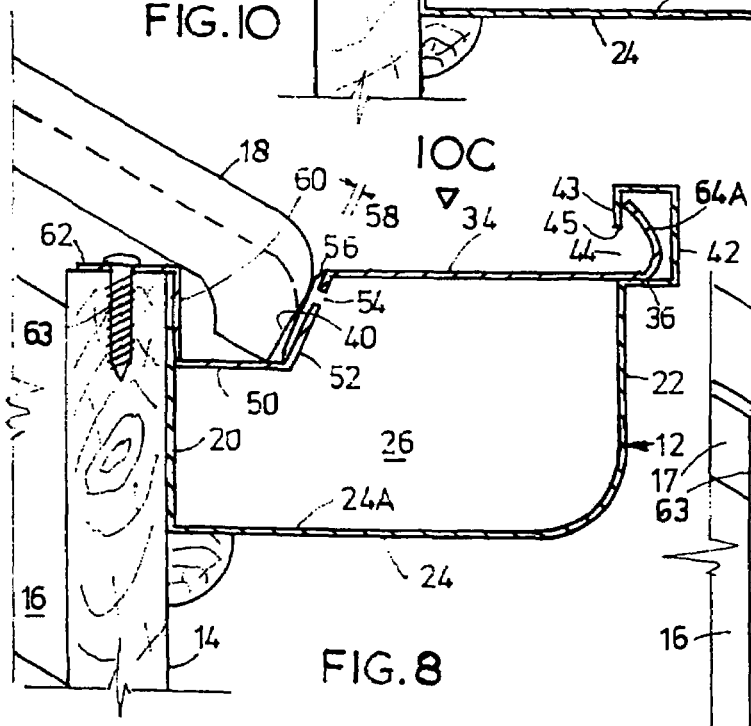
FIG. 8 is a section view of a fourth embodiment of the gutter protector.

FIG. 8 illustrates an embodiment of the gutter protector 10C in which the clip 64A is formed integrally with planar portion 34. This can be achieved by extending the planar portion 34 laterally from outer edge 36 and turning the extended portion upwards in a curved shape to fit inside the rolled edge 42 of the gutter 12 where the longitudinal edge of the extended portion bearing against the inside of wall 43. To fit gutter protector 10C to the gutter 12 the planar portion 34 is raised relative to the floor 24 and the clip 64A is fed through opening 44 of the rolled edge 42. The planar portion 34 is lowered to lie in a substantially horizontal plane leaving the clip 64A fitting inside the wall 43. Flange portion 62 of the gutter protector 10C is then attached by way of screws or nails 63 when the gutter protector 10C is required to act as a structural support akin to a conventional gutter bracket. Accordingly the gutter protector 10C, provides additional support and rigidity to the gutter 12 and obviates the need of conventional gutter brackets or straps which contribute significantly to the build up of leaves and debris in the gutter 12. It can also be used to attach the gutter protector 10C to gutter 12 that have a curved or contoured outer edge.

Figure 9:
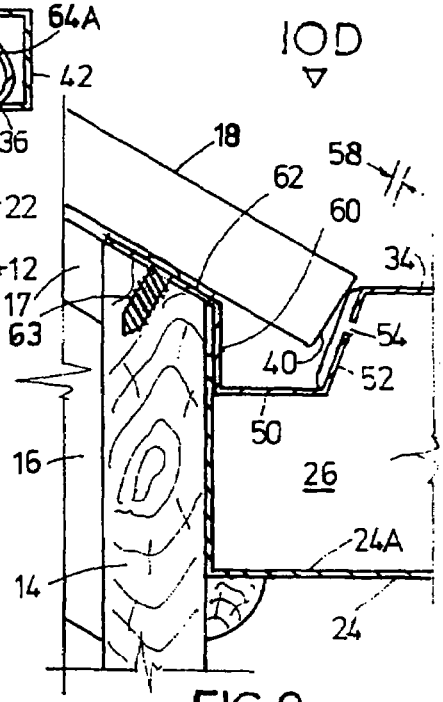
FIG. 9 is a section view of a fifth embodiment of the gutter protector.

FIG. 9 illustrates a further embodiment of the gutter protector 10D which is similar to that depicted in FIGS. 1-5 with the exception that the flange 62 is inclined and can be used when a roof deck 17 is installed under the roof covering 18.

Figure 10:
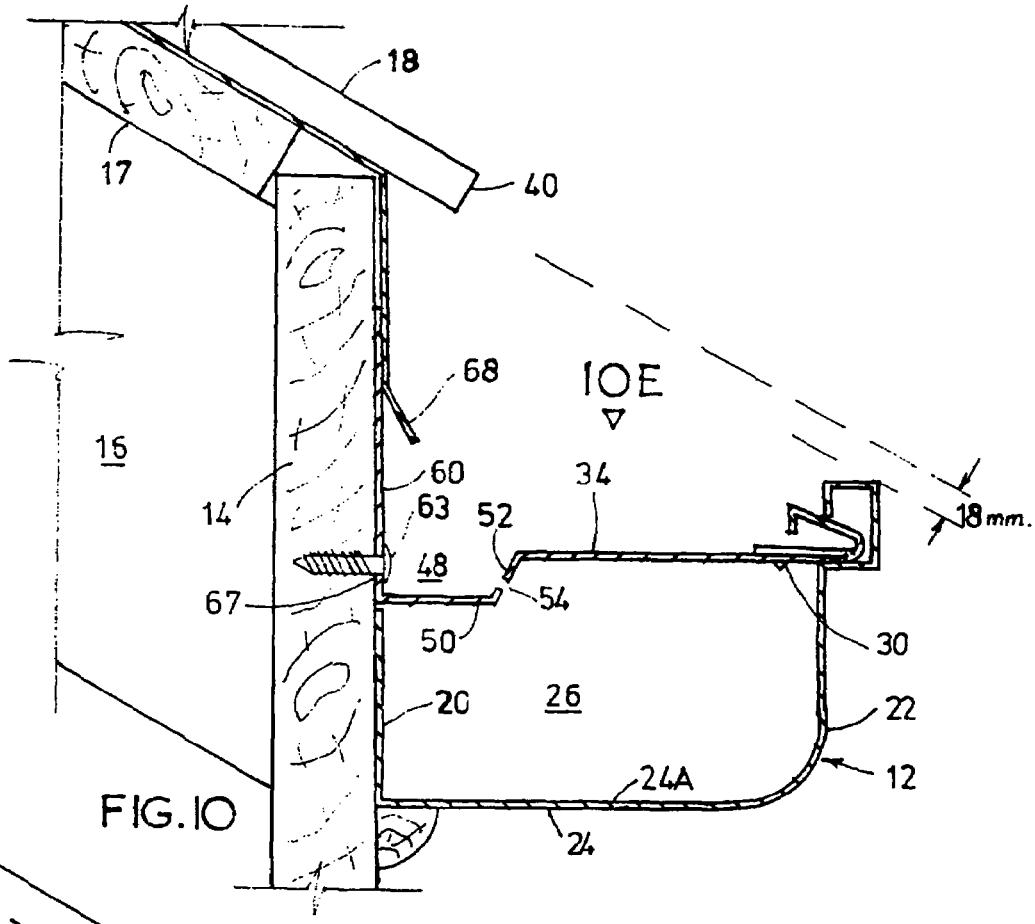
FIG. 10 is a section view of a sixth embodiment of the gutter protector.

FIG. 10 depicts yet a further variation in the gutter protector 10E suitable for use with slate or shingle roof coverings 18 in snow areas. Here, the outer edge of the gutter 12 is placed about 18 mm below the line of the pitch of the roof covering 18 as is the practice in snow areas. As the gutter 12 is disposed below the line of the pitch of the roof 18 the lower edge 40 of the roof covering 18 does not project into the channel 48 and accordingly the channel 48 is made shallower to provide a collection point for water flowing off the roof covering 18 that strikes an intervening metal drip edge 68. The second wall 60 of the channel 48 is extended vertically upward to protrude under the metal drip edge 68. The gutter protector 10E is fixed by screws 63 passing through the second wall 60 in the region of the channel 48 into the fascia 14. Increased rigidity can be achieved by adding a further fixing screw between the first mentioned screw and the lower edge of the drip edge 68. The gutter protector 10E will also reduce the weight of snow on the gutter 12 by forming a barrier to its entry into the gutter channel 26. The composite structure of the gutter protector 10E and the gutter 12 provides greater structural strength than the latter alone.

Figure 13:
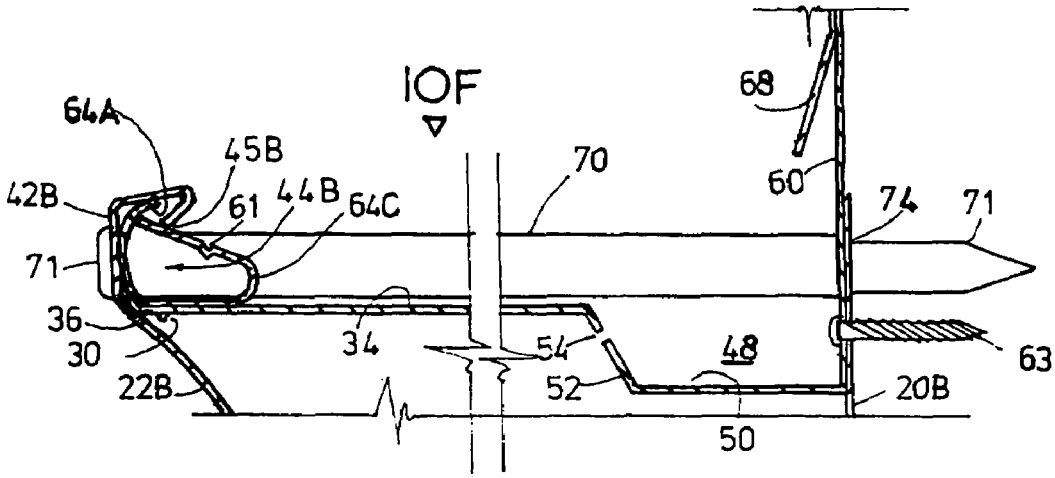
FIG. 13 is a view of section A-A of FIG. 12.
Figure 12:
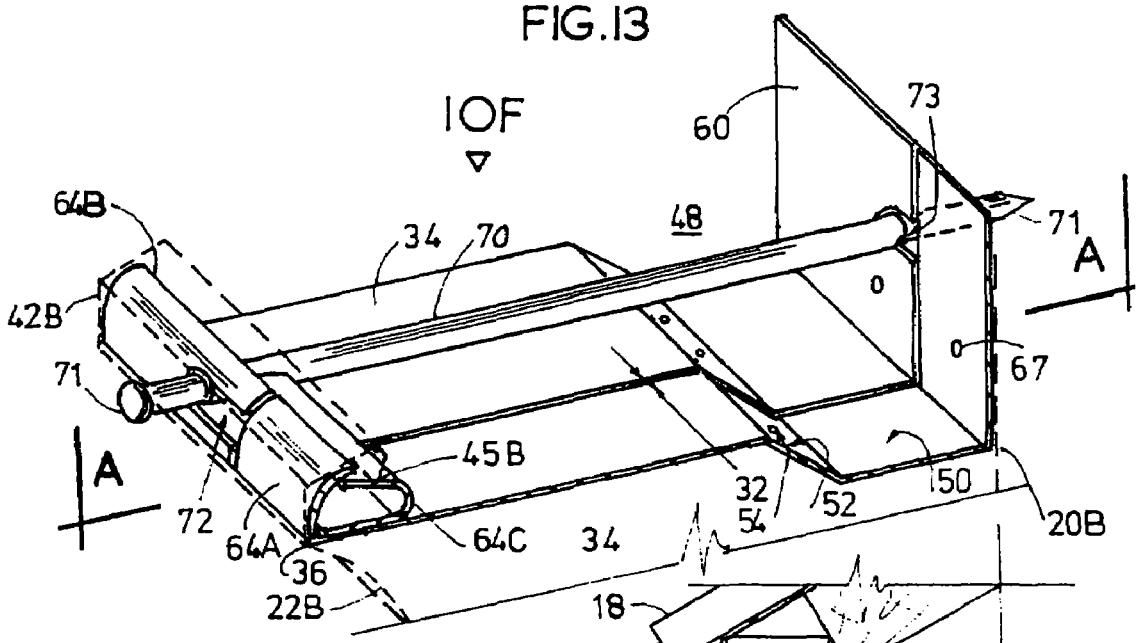
FIG. 12 is a perspective view of the gutter protector depicted in FIG. 11.
Figure 11:
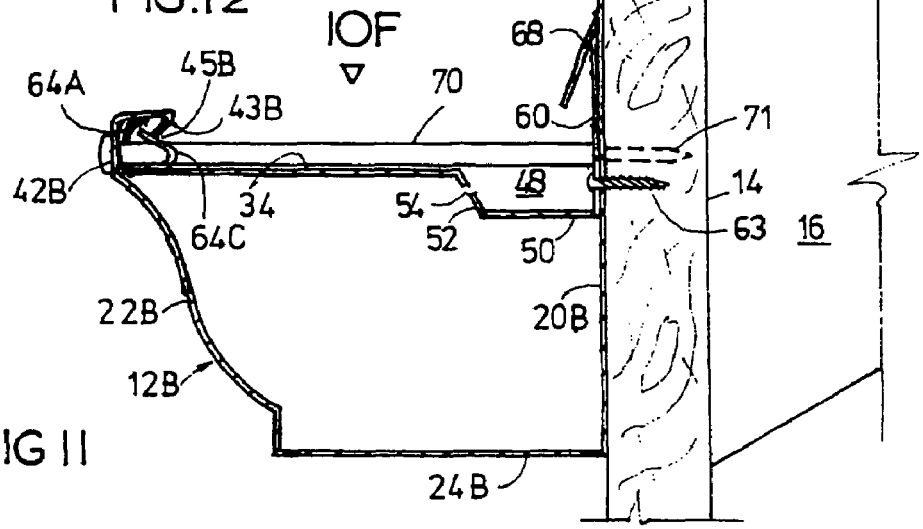
FIG. 11 is a sectional view of the seventh embodiment of the gutter protector.

FIGS. 11-13 illustrate an embodiment of the gutter protector 10F which is suited to use with a known type of gutter 12B that is attached or secured to the fascia 14 by nails 71 which extend through holes formed within the outer wall 22B and the inner wall 20B. The nails 71 extend through a sheet metal or plastic spacer ferrules of tubes 70 which maintain the alignment of the gutter 12B between the outer wall 22B and the inner wall 20B of the gutter. As the gutter 12B is disposed below the line of the pitch of the roof the roof covering 18 does not project into channel 48 and channel 48 is shallower to provide a collection point for the water flowing off the roof covering that strikes the metal drip edge 68 in a similar fashion to gutter protector 10E. The outer wall 22B has a rolled edge 42B at the free end of the outer wall 22B. The rolled edge 42B includes an opening 44B and an upper edge 45B.

Figure 3:
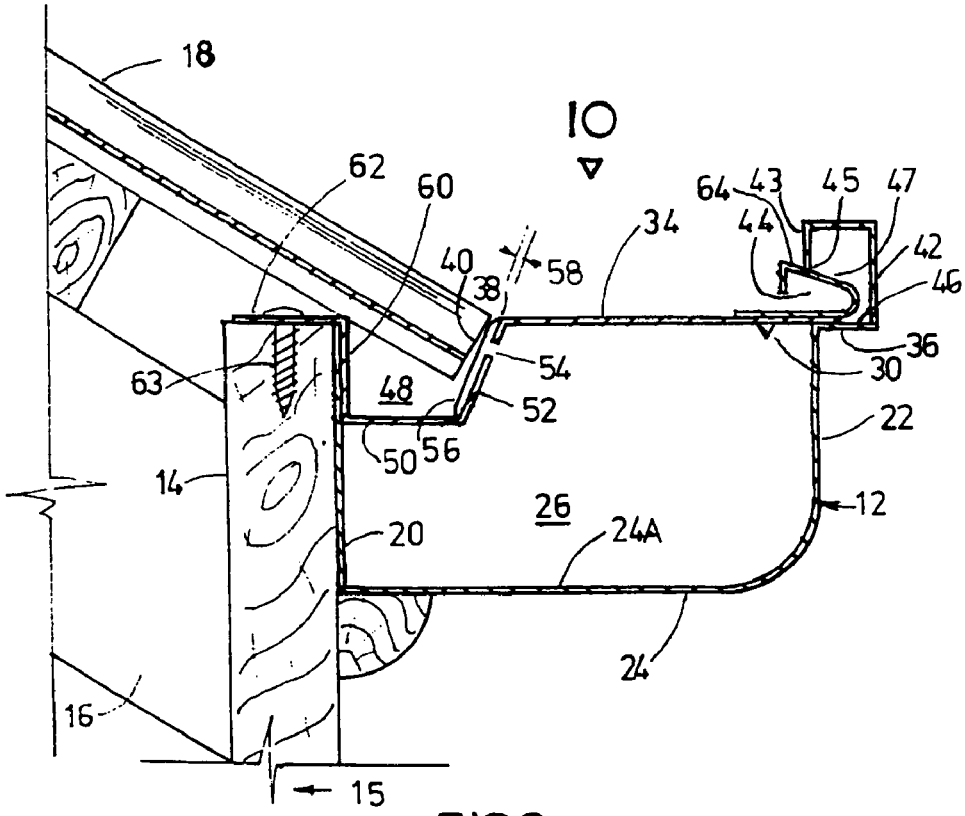
FIG. 3 is a view of section B-B of FIG. 1.

In this embodiment the gutter protector 10F includes a dual clip system comprising an integrally formed clip 64B extending from edge 36 of planar portion 34 in a similar manner to the clip 64A of protector 10C of FIG. 8, and a separate clip 64C with depending spacer 30 as depicted in FIGS. 3, 5 and 7.

The integral clip 64B has a slot 72 to enable the ferrules to pass through the gutter protector 10F and rest against the rolled edge 42B at the outer wall 22B of the gutter 12B and a corresponding slot 73 in the second wall 60 of the channel 48. There also needs to be a hole 74 in the inner wall 20B of the gutter 12B to enable the nail 71 to be driven into the facia 14.

Attachment of the gutter protector 10F to the outer edge 42B of the gutter 12B is completed by the clip 64C which acts in a similar manner as clip 64 but is disposed in an outwardly direction towards the upper rolled edge 45B. It has a groove 61 to allow it to be compressed with a screwdriver or like instrument to force the surface 34 up against the outer rolled wall 22B. This particular form of gutter does not have a defined outer ledge 46 as in other embodiments of the gutter protector and its fixing in the gutter 12B is provided by the action of the integral clip 64A or 64B and the separate clip 64C. In this embodiment of the gutter protector 10F the nail 71 and the ferrule 70 are installed according to existing practice but the gutter protector 10F can be readily installed and fixed in position with the action of the integral clip 64A, separate clip 64C and the screws 63 passed through holes 67 in the wall 60 into the fascia 14.

Figure 14:
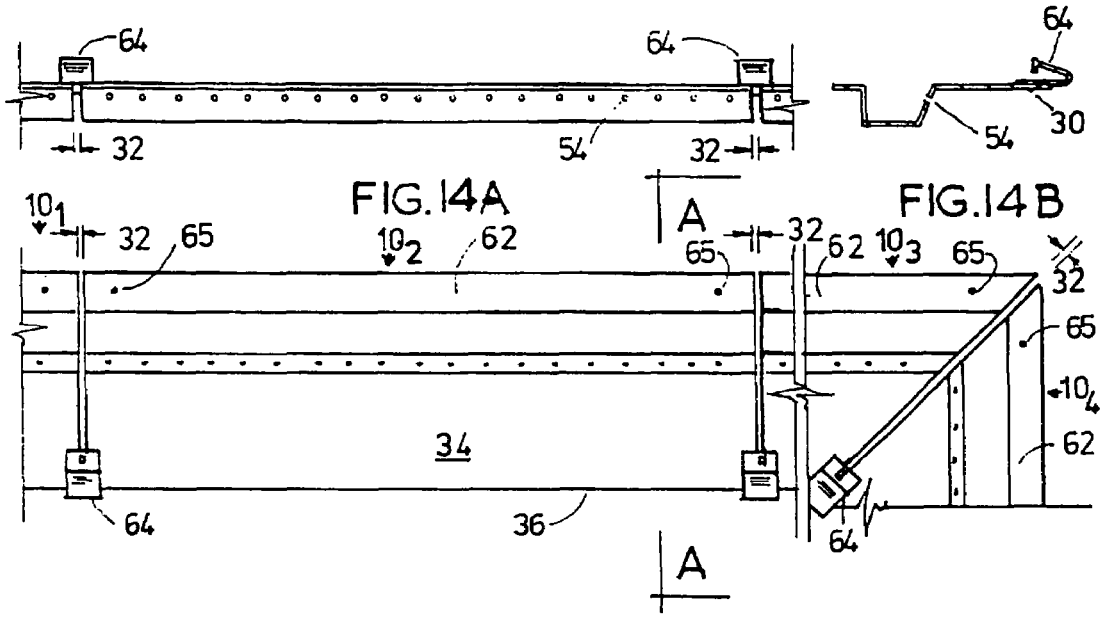
FIG. 14 is a plan view of the gutter protector extending about a corner.

FIG. 14 depicts a series of gutter protectors $\mathbf{10}_1$, $\mathbf{10}_2$, $\mathbf{10}_3$ and $\mathbf{10}_4$ leading to and turning around a 90 degree corner. Gutter protectors $\mathbf{10}_1$ and $\mathbf{10}_2$ are of the same form as gutter protector 10 and of a "standard length". Adjacent gutter protector $\mathbf{10}_3$ which leads into the 90 degree corner is mitred at 45 degrees from outer edge 36 to the free edge of flange 62. An abutting gutter protector $\mathbf{10}_4$ which runs at 90 degrees to gutter protectors $\mathbf{10}_1$, $\mathbf{10}_2$ and $\mathbf{10}_3$ is also formed with a mitred corner to abut the mitred corner of gutter protector $\mathbf{10}_3$. Holes 65 are provided on the flange 62 near but in board of the opposite transverse edges of the gutter protectors $\mathbf{10}_1$, $\mathbf{10}_2$, $\mathbf{10}_3$ and $\mathbf{10}_4$. The screws or nails are driven through holes 65 into the top of the underlying fascia 14. This fixing, together with the action of the spring clips 64 provides increased structural strength of the composite gutter 12 and gutter protector 10 over that which is achieved with a conventional gutter 12 alone. A gap 32 is formed between the protectors $\mathbf{10}_3$ and $\mathbf{10}_4$ above the corner by the provision of a clip 64 at the corner.

Figure 15:
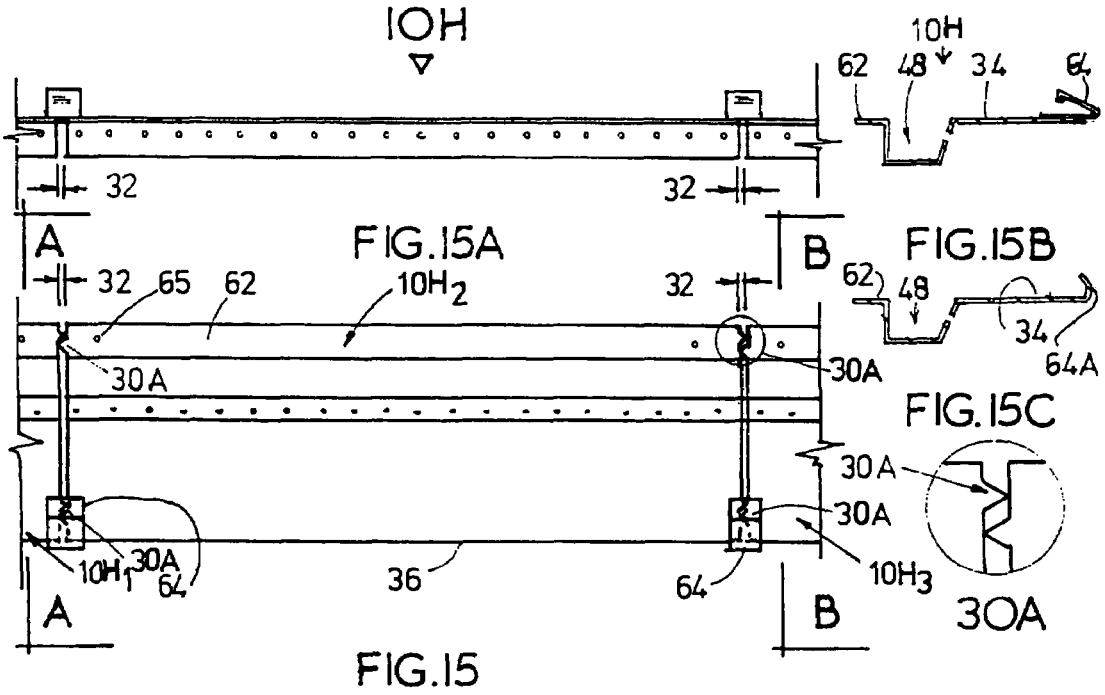
FIG. 15 is a plan view of a eighth embodiment of the gutter protector.

FIG. 15 depicts a plan view of a straight run of gutter protectors $\mathbf{10}H_1$, $\mathbf{10}H_2$ and $\mathbf{10}H_3$ in which the spacer means 30A are in the form of nibs projecting laterally from opposite transverse edges of each section or run of gutter protector 10H. An elevation of the plan is shown in FIG. 15A. The spacers 30A of any one gutter protector 10H abut the transverse edge of an adjacent gutter protector to form the gap 32 between the adjacent gutter protectors. In this embodiment, the spacers 30A at the lateral edge one gutter protector are offset relative to the spacers 30A of an adjacent edge of an adjacent gutter protector 10H.

This embodiment can incorporate two variations of the fixing method of the outer edge 36. The first is depicted in FIG. 15B where the clip 64 is in a form similar to that shown in FIG. 3 but without the depending spacer 30. In an alternate form depicted in FIG. 15C the clip 64A can be formed integrally with the planar portion 34 as depicted in FIG. 8 and as with other embodiments can be used to align and attach the gutter to the fascia. During installation gutter protector $\mathbf{10}H_3$, and another at the other end of the run of gutter 12, or some convenient point, would be both fixed by screws or nails to fascia 14 on the desired alignment to hold the gutter in place to enable it to be fixed to the fascia 14. The intervening collector plate 28 would then be installed.

As the collectors plates 28 are of relatively short length there is considerable flexibility in installation, as the collectors, in its various forms, can be installed in a similar process to laying roof tiles. Likewise a collector/plate 28 can be readily removed to inspect the gutter.

Now that embodiments of the present invention have been described in detail it will be apparent to those skilled in the relevant arts that numerous modifications and variations may be made without departing from the basic inventive concepts. For example, the material from which the gutter protector 10 is made is not critical to the invention. It is envisaged that the gutter protector 10 can be made either entirely or in part from metals, metal alloys, with or without protective coatings, fibreglass and plastics materials either opaque or clear. If the gutter protector 10 is made from a metal or metal alloy it is preferred that the metal or metal alloy be of the same type as the gutter 12 in order to avoid bimetallic corrosion.

While the preferred spacing of the gaps 32 is around 1 to 2 mm, this can vary in accordance with the type of vegetation in the particular area of use. The length of the gutter protectors 10 is dependent on the expected intensity of rainfall in the area of use. The width and depth of channel 48 and the slope of first wall 52 can be varied to suit the particular type of roof covering and pitch of the roof. For example, where the roof covering 18 does not project into the channel 48 (for example where the roof covering is a shingle roof as depicted in FIG. 10) only a nominal depth of channel 48 is required to provide sufficient flow of water into the underlying gutter 12 and stiffness or structural strength to the composite of the gutter 12 and gutter protector 10. In a further variation, the gutter protector 10 can be made of a series of sheets 28 connected together end to end with the separation gaps 32 cut, stamped or otherwise formed between the adjacent profiled sheets 28. In this embodiment the spacers 30 would be formed integrally with the adjacent connected profiled sheets 28. The resulting gutter protector 10 would look quite similar to that depicted in FIG. 15 with the exception that the spacers 30 on adjacent edges would merge with each other and be co-joined to each of the adjacent sheets 28. In yet a further variation, the gutter 12 and gutter protector 10 can be formed as a single unit with conventional mechanical mechanisms to allow for separation or opening of the gutter protector 10 from time to time to provide access into the gutter 12. For example this can be provided by way of a hinge formed longitudinally along inner edge 38 of the planer portion 34. Also, it is possible for the plate 28 to be formed with no channel 48 in which case the plate 28 is substantially flat from outer edge 36 to at least the flange 62.

All such variations and modifications together with others that would be obvious to a person of ordinary skill in the art are deemed to be within the scope of the present invention the nature of which is to be determined from the above description and the appended claims.

The invention claimed is:

1. A gutter protector for a gutter having an inner wall for location adjacent a building to which the gutter is to be attached, a laterally spaced outer wall having an uppermost edge and an invert therebetween, said inner wall, outer wall and invert defining a gutter channel, said gutter protector comprising at least:

a plate having (a) an outer edge being in contact with the outer wall, and (b) opposite transverse edges, the plate forming a substantially liquid impervious barrier between the outer edge and a lower edge of a roof covering supported on the building, and (c) a first planar liquid impervious portion having an inner edge parallel to the said outer edge; the first planar liquid impervious portion disposed substantially horizontally inside the said outer wall and below the said uppermost edge of the said outer wall, the plate extending along said gutter over said gutter channel and above said gutter invert; and a spacer for spacing the transverse edges of adjacent plates by a first gap that allows substantially all the rain water that is collected on the plates to the substantial exclusion of leaves and debris to fall through the first gap onto the gutter invert.

2. A gutter protector according to claim 1 wherein said plate includes first and second planar liquid impervious portions that are substantially parallel to each other and to the floor of the gutter but offset from each other.

3. A gutter protector according to claim 2 wherein the first planar liquid impervious portion has an outer edge for location adjacent the outer wall of the gutter and an inner edge for location adjacent or in substantial alignment with a lower edge of a roof covering supported on the building and disposed above the gutter.

4. A gutter protector according to claim 3 wherein the second planar portion is in the form of a base or floor of a channel disposed adjacent and extending along the inner edge of the planar liquid impervious portion.

5. A method of protecting a gutter having an inner wall, a laterally spaced outer wall having an uppermost edge and an invert therebetween, said walls and invert defining a gutter channel, said method comprising the steps of:

providing a plurality of collectors each collector having (a) an outer edge, (b) opposite transverse edges, and (c) a planar liquid impervious portion having an inner edge parallel to the outer edge; the liquid impervious portion extending between the outer edge and the inner edge, the outer edge being in contact with the said outer wall and the inner edge disposed adjacent or in substantial alignment with a lower edge of a roof covering supported on the building and disposed above the gutter, disposing the planar liquid impervious portion substantially horizontally inside the said outer wall and below the said uppermost edge extending over said gutter invert; disposing said collectors side by side over said gutter and above said gutter invert with said outer edges in contact with said outer wall;

spacing mutually adjacent collectors to form a gap between the respective transverse edges of the collectors of a size that allows substantially all of the rain water that is collected on the collectors to the substantial exclusion of leaves and debris to fall therethrough onto the invert said gap extending across the gutter channel between said inner wall and said outer wall.

6. A gutter protector for use with a gutter attached to a building, the gutter having an inner wall located adjacent the building, a laterally spaced outer wall having an uppermost edge and a floor therebetween, said walls and floor defining a gutter invert, said gutter protector comprising at least:

a collector having (a) an outer edge, (b) opposite transverse edges, and (c) a planar liquid impervious portion having an inner edge parallel to the outer edge; the liquid impervious portion extending between the outer edge and the inner edge, the outer edge being in contact with the said outer wall and the inner edge disposed adjacent or in substantial alignment with a lower edge of a roof covering supported on the building and disposed above the gutter, the planar liquid impervious portion disposed substantially horizontally inside the said outer wall and below said uppermost edge of said outer wall, extending over said gutter invert and above said floor for collecting water, leaves and debris that would otherwise directly collect in the gutter invert; and a spacer for spacing the transverse edges of adjacent collectors by a first gap that allows substantially all the rain water that is collected on the collectors to the substantial exclusion of leaves and debris to fall through the first gaps onto the gutter invert.

7. A gutter protector according to claim 6, wherein said collector includes a channel disposed adjacent and extending along said inner edge of said planar liquid impervious portion, the channel having a base disposed below said planar liquid impervious portion.

8. A gutter protector according to claim 7, wherein said channel includes a first wall extending from the channel base to the inner edge of the planar liquid impervious portion, said first wall is provided with at least one aperture at a predetermined level above said base through which water falls into the gutter invert when water in the channel is above said predetermined level.

9. A gutter protector according to claim 8, wherein said first wall is provided with at least one protrusion for abutment with the lower edge of the roof covering to form a second gap between the first wall and the roof covering.

10. A gutter protector according to claim 9, wherein the first wall is inclined to form an obtuse included angle with the base.

11. A gutter protector according to claim 9, wherein said channel includes an upwardly extending second wall laterally spaced from the first wall by the base for coupling with said building.

12. A gutter protector according to claim 11, wherein the second wall includes a flange for disposing over a fascia of the building.

13. A gutter protector according to claim 11 or 12, wherein the second wall extends upwardly above the planar liquid impervious portion.

14. A gutter protector according to claim 11, wherein the collector includes a third wall depending from the channel on a side adjacent the second wall for seating on said gutter invert.

15. A gutter protector according to claim 14, wherein the third wall is a folded portion of the second wall.

16. A gutter protector according to claim 6 further including a clip for releasably attaching the collector to the gutter.

17. A gutter protector according to claim 16, wherein the spacer to be positioned between the transverse edges of the planar liquid impervious portions is formed integrally within said clip.

18. A gutter protector according to claim 16, wherein said clip is formed integrally with said collector.

19. A gutter protector according to any one of claims 16, 17 or 18 wherein said clip includes an engagement portion that engages an edge of the outer wall of the gutter whereby said clip acts between said outer wall of the gutter and said collector to hold said collector in said gutter.

20. A gutter protector according to claim 6 wherein said spacer is formed integrally along at least one transverse edge along the collector.

21. A gutter protector according to claim 6 wherein said collector is one of a plurality of adjacent collectors where mutually adjacent collectors are spaced by respective spacers.

22. A gutter comprising at least:

an inner wall for location adjacent a building to which the gutter is attached;

a laterally spaced outer wall and a floor therebetween, said walls and floor defining a gutter invert; and a gutter protector in accordance with claim 6 coupled to said gutter and extending over said gutter invert.

23. A gutter protector for use with a gutter attached to a building, the gutter having an inner wall located adjacent the building, a laterally spaced outer wall having an uppermost edge and a floor therebetween, said walls and floor defining a gutter invert, said gutter protector comprising:

a series of integrally formed end to end collectors extending over said gutter invert and above said floor for collecting water, leaves and debris that would otherwise directly collect in the gutter invert, each collector comprising (a) an outer edge, (b) opposite transverse edges, and (c) a planar liquid impervious portion having an inner edge parallel to the outer edge; the liquid impervious portion extending between the outer edge and the inner edge, the outer edge being in contact with the said outer wall and the inner edge disposed adjacent or in substantial alignment with a lower edge of a roof covering supported on the building and disposed above the gutter, the planar liquid impervious portion being disposed substantially horizontally inside the said outer wall and below the said uppermost edge wherein adjacent collectors are separated by integrally formed spacers to form respective first gaps provided between the transverse edges of respective collectors through which substantially all the rain water that is collected on the collectors to the substantial exclusion of leaves and debris falls onto the gutter invert.

* * * * *